United States Patent [19]

Johnson et al.

[11] Patent Number: 4,704,952

[45] Date of Patent: Nov. 10, 1987

[54] METHOD AND APPARATUS FOR APPLYING PAINT

[75] Inventors: Jeffrey C. Johnson; Stephen Rothon, both of Birmingham; Andrew J. Slater, Troy, all of Mich.

[73] Assignee: Hayden Schweitzer Corp., Madison Heights, Mich.

[21] Appl. No.: 795,856

[22] Filed: Nov. 7, 1985

[51] Int. Cl.[4] ..... B05B 15/12

[52] U.S. Cl. ..... 98/115.2; 55/241; 55/DIG. 46

[58] Field of Search ..... 55/241, 257 PV, 257 QV, 55/DIG. 46; 98/115.2; 118/326, DIG. 7

[56] References Cited

U.S. PATENT DOCUMENTS 4,440,554 4/1984 Perry ..... 98/115.2 X

FOREIGN PATENT DOCUMENTS 2161198 9/1972 Fed. Rep. of Germany ..... 98/115.2

1109202 8/1984 U.S.S.R. ..... 118/326

*Primary Examiner*—Harold Joyce

*Attorney, Agent, or Firm*—Niro, Scavone, Haller & Niro

[57] ABSTRACT

A paint spray booth in which articles such as automobiles are sprayed while moving along a conveyor line passing through the working area of the booth. Air is moved from an area above the articles and downwardly around the articles for discharge through a plurality of longitudinally spaced vertical passages positioned along the center line of the booth and water supplied to a pan positioned beneath the articles is caused to cascade down the vertical passages for mixture with the spray-laden air so that the spray is transferred from the air to the water. As the air leaves the lower ends of the vertical passages, it is directed laterally to impact one side of the booth, thence abruptly upwardly to separate entrained water, and thence in the other lateral direction toward the other side of the booth for passage through the spaces defined between the vertical passages. The tubular members defining the vertical passages are arranged to provide a baffling action and cause the air to give up remaining water so that the air discharged from the exhaust stack of the spray booth is substantially free of water and hence may be discharged into the atmosphere without fear of polluting surrounding areas.

17 Claims, 4 Drawing Figures

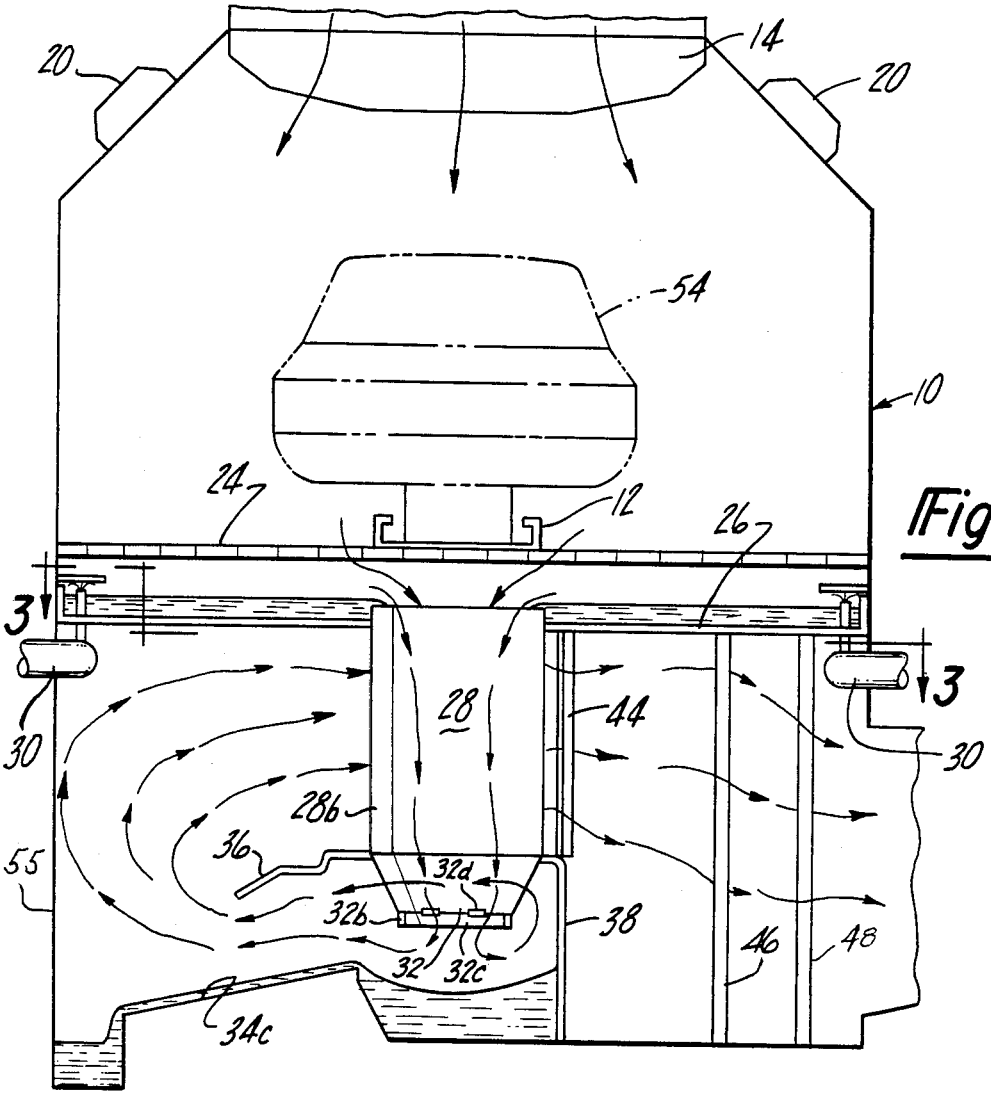
Fig-2
Fig-4
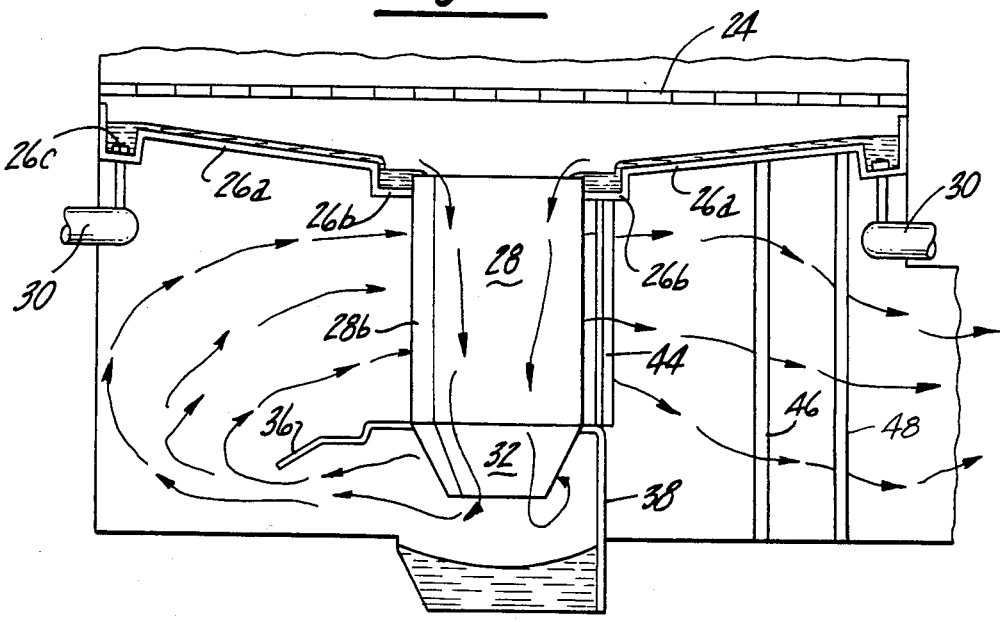

METHOD AND APPARATUS FOR APPLYING PAINT

TECHNICAL FIELD

This invention relates to liquid activated apparatus for removing particulate matter from an air stream, commonly called "wet scrubbers," and more particularly to a wet scrubber apparatus having a highly efficient means for separating the liquid and particulates from the air stream prior to exhaust. The invention is especially useful in spray painting facilities.

BACKGROUND OF THE INVENTION

It is customary to spray paint automobiles and other mass produced articles in a spray booth having the physical characteristics of an elongated corridor or chamber through which the automobiles are longitudinally conveyed and within which human and/or mechanical operators actuate paint spraying equipment. It is essential in the operation of a paint spray booth to maintain a proper supply of fresh air and to remove paint overspray by means of an air exhaust system.

Paint overspray is conventionally removed from the booth by drawing the air from the booth downwardly through hollow outlet structures which are disposed centrally of a subfloor within the booth at longitudinally spaced intervals. Depending on its angularity, the subfloor is either flooded or wetted with water. The water flows into and through the outlet structures to mix with the overspray-laden air passing downwardly therethrough and assists in the transfer of the overspray from the air to the water so that the air leaving the lower ends of the outlet structures can be substantially free of entrained overspray. See as examples U.S. Pat. Nos. 3,421,293 to Halls and 4,222,319 to Donohue, both of which show wet scrubbers in downdraft type spray booths.

Whereas this prior art system is generally satisfactory in removing overspray from the air, the air leaving the lower ends of the outlet structures continues to carry considerable water into and along the length of the exhaust system.

BRIEF SUMMARY OF THE INVENTION

This invention is directed to the provision of a wet scrubber having improved dewatering means.

More specifically, this invention is directed to a wet scrubber for use in a downdraft type paint spray booth in which the air leaving the lower ends of the outlet structures in the wetted or flooded subfloor is caused to undergo a directional change of up to 270°, thereby effectively throwing off water in the immediate vicinity of the scrubber discharge; i.e., in the underfloor chamber where the paint-laden water is collected and directed by sluiceways to a treatment facility.

As a further refinement and in combination with the large-directional-change feature of the air flow pattern just described, the scrubber of the present invention may utilize the scrubber bodies themselves as dewatering devices by directing the exhaust air laterally through the depending bodies under the water-wetted or flooded subfloor.

A paint spray booth constructed according to the invention is of the type including an elongate housing defining a working area suitable for containing the article; a perforate working floor; a pan or floodsheet positioned in spaced relation beneath the perforate working floor; a plurality of longitudinally spaced vertically oriented outlet structures defining longitudinally spaced outlet passages opening at their upper ends in the pan or floodsheet beneath the perforate working floor and opening their lower ends beneath the pan; means for producing a flow of air to the working area from overhead and for causing the air to flow downwardly around the article and thence downwardly toward the outlet passages so as to entrain overspray from the spraying operation and carry it downwardly toward the outlet passages; and means for supplying water to the pan and for causing the water to cascade downwardly through the outlet passages to mix with the overspray-laden air passing downwardly therethrough and assist in the transfer of the overspray from the air to the water. According to the invention, the air leaving the lower ends of the outlet passages is directed in one lateral direction toward one side of the booth, thence upwardly toward the pan, and thence in the opposite lateral direction toward the other side of the booth for discharge through an exhaust positioned at the other side of the booth. The large directional change of the discharge air and the impact of the air/water operation on the structure of the underfloor chamber provides a simple and effective means of separating the entrained water from the discharge air in the underfloor chamber itself where the water is not easily collected and where maintenance is most readily performed.

According to a further feature of the invention, the outlet structures are arranged to present a combined longitudinal surface area that substantially precludes movement of the air therethrough in a direction normal to the longitudinal center line of the booth so that the air is made to move serpentinely between the outlet structures to increase the baffling action.

According to a further feature of the invention, each outlet structure is oblong and is arranged with its major axis disposed obliquely with respect to the longitudinal center line of the booth so that the air is caused to impact in a baffling manner against the outlet structures and then move obliquely between the outlet structures for discharge by the exhaust structure.

According to a further feature of the invention, the spray booth further includes a base floor positioned beneath the lower ends of the outlet structures, a generally horizontal, longitudinally extending partition positioned between the base floor and the pan in surrounding relation to the lower end portions of the outlet structures; and a generally vertical, longitudinally extending partition extending between the horizontal partition and the base floor at the side of the outlet structure facing the discharge side of the booth so as to prevent the air leaving the lower ends of the outlet passages from moving directly laterally toward the discharge and force it to move in the opposite lateral direction and thence upwardly and thence laterally between the outlet structures for ultimate discharge.

According to a further feature of the invention, a nozzle is provided at the lower end of each outlet structure to control the air and water exiting from the associated outlet structure and allow the airflow characteristics of the outlet structure to be varied by simply adjusting or changing the nozzle.

BRIEF DESCRIPTION OF THE DRAWINGS

FIG. 2 is a transverse cross-sectional view of the paint spray booth of FIG. 1;

FIG. 4 is a transverse cross-sectional view showing an alternate embodiment of the invention paint spray booth.

DETAILED DESCRIPTION OF THE PREFERRED EMBODIMENTS

Figure 1:
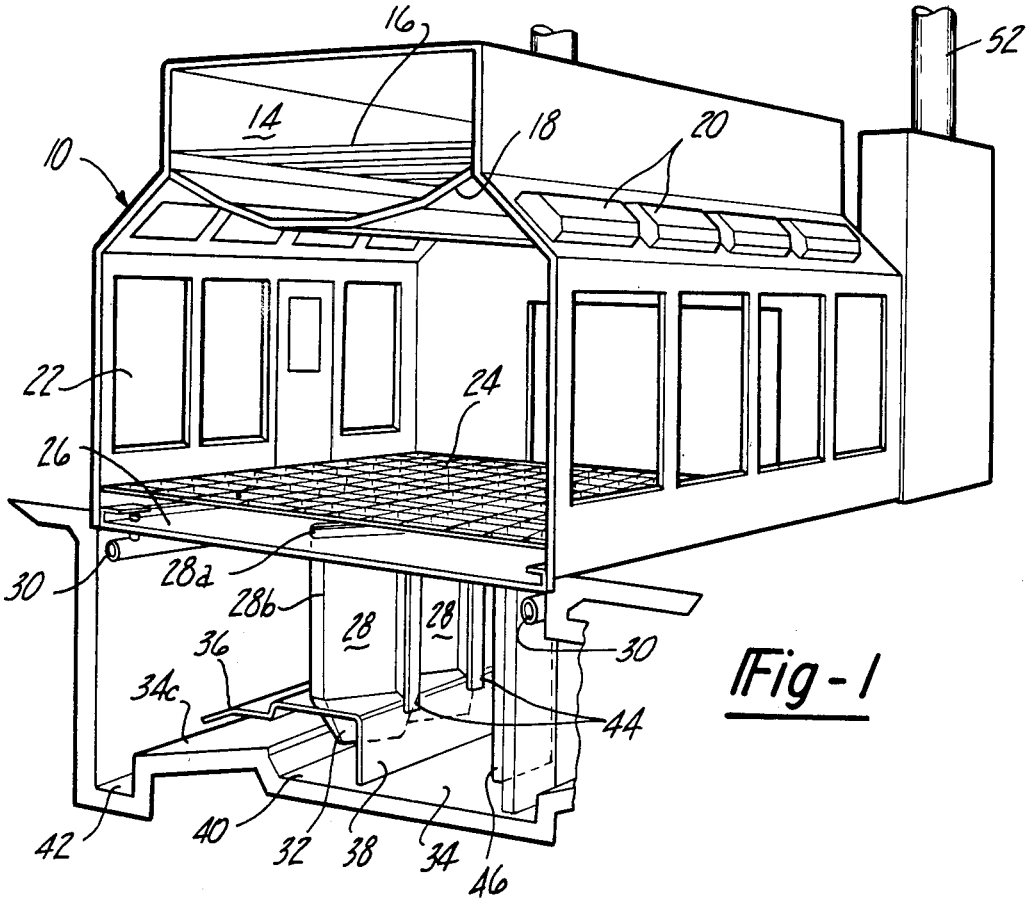
FIG. 1 is a perspective cross-sectional view of a paint spray booth according to the invention.

The paint spray booth shown in FIG. 1 is epecially designed for automobiles or other mass produced articles and includes an elongate housing structure 10 defining a large open interior area through which automobiles or other articles are towed by means of a conveyor 12 and around which a human or robotic operator or machine may move to spray paint on the automobile bodies as they pass longitudinally through the structure 10. Above the main working area is an air supply plenum 14 having adjustable baffles 16 and a diffusion ceiling 18 made of porous urethane foam or the like. Lights 20 are disposed continuously along the spray booth structure to illuminate the working area and windows 22 are disposed in the side walls of structure 10 to permit the interior operations to be viewed and to create an open airy atmosphere with the spray booth.

The working floor is defined by a semi width gratings 24 between which the conveyor 12 is centrally traversed. Disposed approximately 18 inches beneath the grating 24 is a subfloor 26 in the form of a deep pan which is substantially flat. A plurality of longitudinally spaced, vertically oriented outlet structures 28 are positioned in pan 26 in longitudinally spaced relation along the longitudinal center line of the spray booth. The structures 28 are preferably fabricated from thin gage metal, galvanized or plated for corrosion resistance, and welded or otherwise secured to pan 26.

Each outlet structure 28 has a rectangular shape in cross section and is positioned with its major axis disposed obliquely with respect to the longitudinal center line of the booth. The upper portions **28*a* of the outlet structures extend above the pan 26 by approximately three inches to thereby create a pool of approximately three inches when pan 26 is supplied with water as, for example, through conduits 30 extending longitudinally along either side of the booth beneath the pan 26. Outlet structures 28 further include lower portions 28*b* which extend below pan 26 for several feet, and a nozzle 32 is secured to the lower end of the lower portion 28*b* of each outlet structure 28 and defines a lower opening 32*a* whicch is restricted both laterally and longitudinally with respect to the cross-sectional dimensions of the outlet structure. The nozzles may comprise fized structures or may, as seen in FIGS. 2 and 3 include fixed end plates 32*b* and side plates 32*c* hinged at 32*d* so as to be pivotally adjustable to vary the size of outlet 32*a***.

A base floor 34 is positioned beneath the lower ends of nozzles 32. A generally horizontal, longitudinally extending partition 36 is positioned at the lower end of lower outlet structure portions **28*b* and sealingly surrounds the lower ends of the outlet structures. A further generally vertical, longitudinally extending partition 38 extends between one lateral edge of partition 36 and base floor 34 at the right-hand side of outlet structures 28 as viewed in FIG. 2. The lower end of vertical partition 38 coacts with portions 34*a* and 34*b* of base floor 34 to form a trough or water pond 40 immediately underlying outlet structures 28. Water pond 40 extends the full length of spray booth 10 and is positioned generally along the longitudinal center line of the booth. A sloping surface 34*c* of base floor 34 defines a spillway extending between the pond 40 and a sluice 42 extending longitudinally along the left side of booth 10 as viewed in FIG. 2**.

Figure 3:
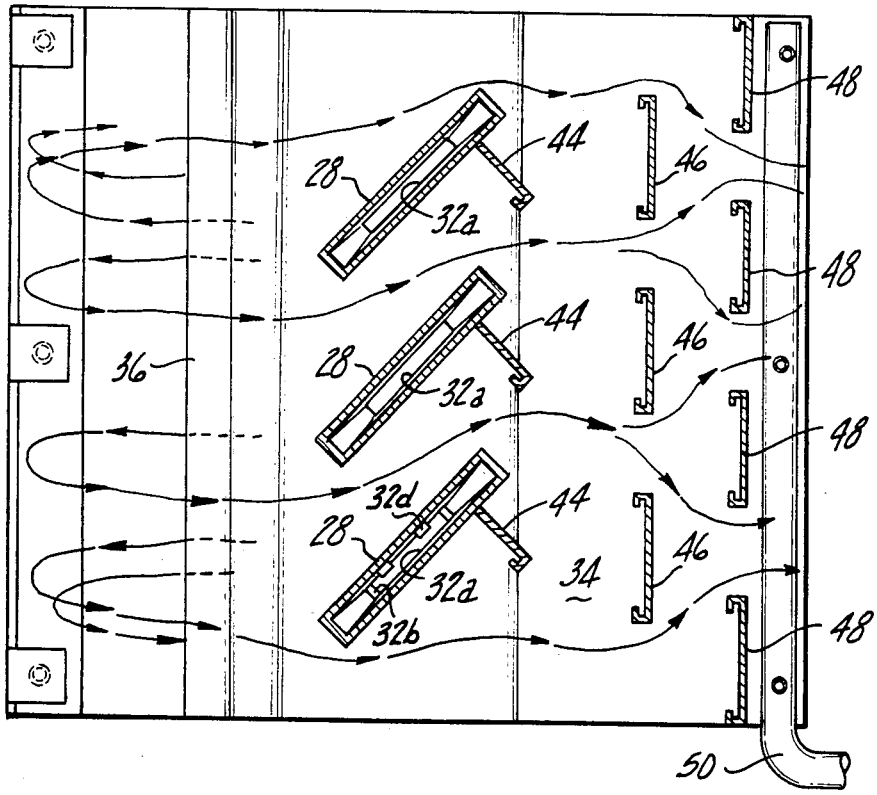
FIG. 3 is a cross-sectional view taken on lines 3—3 of FIG. 2.

As best seen in FIG. 3, a baffle 44 is secured so and extends perpendicularly with respect to each outlet structure 28 and one or more troughs 45 are formed in partition 36 and extend obliquely from a baffle 44 to the free or left edge **36*a* of partition 36. Further baffles 46 and 48 extend between pan 26 and base floor 34 on the right-hand side of the outlet structures 28 as viewed in FIG. 2. An exhaust stack or conduit 50 communicates with the lower right-hand side of the spray booth. Conduit 50 in turn communicates with an exhaust stack 52** positioned exteriorally of the spray booth.

In operation, car bodies 54 or other articles to be sprayed are moved through spray booth 10 on conveyor 12 and paint is applied in a spraying operation to the car bodies by human operators or suitable robotic equipment. Suitable exhaust means (not shown) cause fresh air to flow into supply plenum 14 and thence downwardly through the diffusion ceiling 18 around automobile bodies 54 and thence downwardly through grate 24. The air as it moves downwardly around the car bodies entrains the overspray generated in the spraying operation. Water is delivered on a continuing basis through conduits 30 to pan 26 to fill the pan to the height of upper outlet structures **28*a*. The air flowing downwardly through edge 24 is pulled downwardly through outlet structures 25 and as the air flows downwardly through structures 28, it mixes with the water flowing in cascade style downwardly through structures 28 and the vast majority of the paint spray entrained in the air is transferred in the mixing action occurring within structures 28 from the air to the water. As the paint-laden water exits through nozzles 32, it is deposited in pond 40 and thereafter overflows the pond 40 and flows down spillway 34*c* and into sluice 42 where it is carried away for recirculation through conduits 30**.

Prior to recirculation through conduits 30, the water is passed through a separator to remove the entrained paint and through a treatment station where chemicals are added to minimize the tendency of the entrained paint to stick to the metalwork of the scrubber and to facilitate separation of the entrained paint from the water in the separation station. The air leaving the lower ends of nozzles 32 is substantially free of entrained paint spray but does continue to contain a substantial amount of entrained chemically treated water. The air leaving the lower ends of nozzles 32 flows to the left as viewed in FIG. 2 between subfloor 34 and partition 36 until it reaches the left-hand edge portion **36*a* of partition 36, whereafter it flows abruptly upwardly toward the undersurface of pan 26. As the air turns and flows abruptly upwardly, most of the entrained water is thrown against the lower left wall 55 of the booth from where it drains downwardly into sluice 42. After turning abruptly upwardly to throw off most of the entrained water, the air reverses lateral direction and flows toward outlet conduit 50. As the air flows toward outlet conduit 50, or to the right as viewed in FIG. 2, it passes through the spaces between the lower portions 28*b* of outlet structures 28**.

As best seen in FIG. 3, the outlet structures are positioned and dimensioned such that their combined longitudinal surface area, when projected onto the imaginary longitudinal center plane of the booth, substantially covers that plane and in fact may provide a small degree of overlap as between the successive outlet structures. The air moving through the outlet structures is therefore precluded from moving directly between the structures in a direction normal to the longitudinal center line of the booth so that the air is baffled by the outlet structures and gives up the remaining entrained water to the baffle structures. Specifically, as best seen in FIG. 3, the air moves between the outlet structures 28*b* through oblique passages 34 and in so moving is forced to impact against the longitudinal surface of at least one outlet structure lower portion 28*b*. The air moving between the outlet structures also impacts partitions 44 to further ensure that all remaining spray is removed and further impacts against one or more of baffles 46 and 48 which, as seen in FIG. 3, are staggered with respect to each other so as to preclude direct movement of the air therethrough and so as to ensure impacting of the air against at least certain of these baffles. Water removal by structures 28 and baffles 44 is removed by troughs 45 for drainage onto spillway 34*c* for discharge into sluice 42.

The air leaving the spray booth through discharge 50 is thus substantially totally free of entrained water spray and may be discharged through exhaust stack 52 to the atmosphere without further treatment. Specifically, the air exiting stack 52 has been substantially dewatered so that it may be discharged into the atmosphere without fear of staining of adjacent surface areas or derogation of adjacent finishes by the chemicals added to the water to facilitate paint separation.

In the alternate embodiment shown in FIG. 4, the water pan 26 includes sloping portions 26*a* on either lateral side of the longitudinal center line of the booth which may also feed into a central longitudinal trough 26*b* into which the upper ends 28*a* of the outlet structures 28 project. Water is supplied to the pan 26 through troughs 26*c* extending along the longitudinal edges of the pan. In this embodiment, the sloping base floor spillway surface 34*c* is eliminated and the sluice 42 is eliminated. The pond 40 also constitutes a sluice in this embodiment and provision is accordingly made to move the water continuously in a longitudinal direction through the pond. This arrangement has the advantage of more effectively removing large items of debris such as paint sludge or the like that may fall downwardly through the outlet structures 28 and into the pond. The structure and operation of the embodiment of FIG. 4 is otherwise similar to that described with respect to the FIG. 1–3 embodiment.

The invention spray booth structure will be seen to provide many important advantages. Specifically, the arrangement whereby the air exiting the lower ends of the outlet structures is caused to travel between the outlet structures before exiting the spray booth provides a simple and effective means for dewatering the air without adding any significant further structure to that already provided and necessary to accomplish the cascading and mixing function occurring between the air and water moving downwardly through the outlet structures. The invention arrangement thus provides an effective dewatering function without any substantial additional structures. In addition to the dewatering action provided by the outlet structures as the air is moved between the outlet structures, the air is also forced to give up entrained water by the sharp turn imparted to it as it leaves the lower ends of the nozzles and moves toward the left side of the booth as viewed in FIG. 2. The sharp turn thus imparted to the air, in combination with the baffling action achieved by the passage of the air between the outlet structures and through the further baffles 44, 46 and 48, ensures that the air leaving the spray booth is substantially dewatered and totally fit for discharge into the atmosphere. Further, the nozzles provided on the lower ends of the tubes provide a convenient way of altering the flow characteristics of the tubes without actually changing the tubes. Specifically, various sized nozzles may be selectively interchanged to provide different sized openings at the lower ends of the nozzles and therefore provide different flow characteristics specifically tailored to specific spray booth applications or nozzles may be adjustable, as seen in FIG. 5, to provide the desired specific flow characteristics by selected adjustment of the nozzle opening size. The alternate embodiment shown in FIG. 4 has the advantage of combining the water pond with the sluice so that large articles falling into the pond are effectively carried away by the continuous flow of water in the pond.

Although preferred embodiments of the invention have been illustrated and described in detail, it will be apparent that various changes may be made in the disclosed embodiments without departing from the scope or spirit of the invention. For example, the scrubber tubes or outlet structures 28 need not be rectangular in shape but could be square, round or oval on the booth centerline. Offset, staggered and paired arrangements are feasible. Further, the structures 28 may function with a flat, deep-flooded floor or with a sloping, wetted floor or with a combination. Of course, the invention is not limited to paint spray booths as the scrubber can remove particulates other than paint.

We claim:

1. For use in combination with a work station in which air-borne particulates are generated, a wet scrubber apparatus comprising:

a generally horizontal partition and a tubular discharge structure depending from said partition;

means causing a flow of liquid into said discharge structure;

means causing a flow of particulate-laden air into and through said discharge structure; and means cooperative with said generally horizontally partition defining a chamber into which said discharge structure projects for causing a redirection of substantially all of said flow of air through approximately 270° after it leaves said discharge structure, said flow of redirected air also externally passing an intermediate portion of said discharge structure.

2. The apparatus as defined in claim 1 including a plurality of said discharge structures and wherein said flow of redirected air further passes between adjacent discharge structures.

3. A paint spray booth for applying paint in a spraying operation to an article, said booth comprising:

an elongate housing defining a working area suitable for containing the article to be sprayed;

a pan positioned beneath said working area;

a vertically oriented outlet structure defining outlet passage means opening at its upper end in said pan beneath said working area and opening at its lower end beneath said pan;

means for supplying air to the working area from overhead and for causing said air to flow downwardly around the article and thus downwardly toward said outlet passage means and for causing said air to entrain paint overspray from the spraying operation;

means to accelerate said air and entrained overspray and carry it downwardly through said outlet passage means;

means for supplying water to said pan and for causing the water to cascade downwardly through said outlet passage means to mix with said air and entrained overspray passing downwardly through said outlet passage means and to transfer said overspray from the air to the water; and means for directing substantially all of said air leaving said outlet passage means in a lateral direction toward one side of said booth, then upwardly toward said pan, and then in the opposite lateral direction for discharge through an exhaust structure positioned at the other side of said booth, said directed air thereby flowing passed an intermediate portion of said outlet structure.

4. A paint spray booth according to claim 3 wherein:

said outlet structure comprises a plurality of spaced vertically oriented hollow outlet structures; and the air moving laterally toward said other side of said booth is passed either through the spaces between said outlet structures or the spaces between said outlet structure and end walls of said booth.

5. A paint spray booth according to claim 4 wherein:

said outlet structures are arranged within said elongate housing to present a combined longitudinal surface area that substantially precludes unimpeded movement of said air therebetween in a direction normal to the longitudinal center line of said booth, whereby said air is baffled by said outlet structures to remove any remaining entrained water.

6. A paint spray booth according to claim 4 wherein:

said outlet structures are positioned in longitudinally spaced relation along the longitudinal center line of said booth and are arranged in longitudinally overlapping relation so as to constitute baffles with respect to the air moving laterally therebetween to remove any remaining water.

7. A paint spray booth according to claim 5 wherein:

each said outlet structure is of rectangular cross section and is arranged with its major axis obliquely disposed with respect to the longitudinal center line of said booth.

8. A paint spray booth according to claim 7 wherein:

the major axes of said outlet structures are parallel to one another.

9. A paint spray booth according to claim 8 wherein:

a nozzle is provided at the lower end of each said outlet structure to control the air and water exiting the associated outlet structure and including means for adjusting the nozzle to allow the airflow characteristics of the outlet structure to be varied.

10. A paint spray booth according to claim 3 wherein said booth further includes:

a base floor positioned beneath the lower end of said outlet structure;

a generally horizontal, longitudinally extending partition positioned between said base floor and said pan in surrounding relation to the lower end portion of said outlet structure; and a generally vertical, longitudinally extending partition extending between said horizontal partition and said base floor at the side of said outlet structure facing said other side of said booth, whereby to prevent the air leaving the lower ends of said outlet passage means from moving directly laterally toward said other side of said booth.

11. A paint spray booth according to claim 10 wherein:

said horizontal partition extends towards said one side of said booth to a lateral location intermediate said one side of said booth and the other side of said outlet structure, whereby to force said air to move a substantial distance in said one lateral direction before moving upwardly for travel in said opposite lateral direction.

12. A paint spray booth according to claim 11 wherein:

said outlet structure comprises a plurality of longitudinally spaced vertically oriented hollow outlet structures positioned along the longitudinal center line of said booth;

the air moving laterally toward said other side of said booth is passed through either the spaces between said outlet structures or the spaces between said outlet structure and end walls of said paint booth;

each of said outlet structures has a rectangular cross section with its major axis obliquely disposed with respect to said longitudinal center line; and the combined longitudinal surface area presented by said outlet structures substantially precludes unimpeded movement of said air therebetween in a direction normal to said longitudinal center line so that the air is baffled by said outlet structures and moves obliquely between said outlet structures.

13. A method of removing overspray from a paint spray booth comprising the steps of:

introducing air in the upper regions of the booth above the articles being sprayed;

passing the air downwardly around the articles being sprayed to entrain overspray from the spray operation;

passing the overspray-laden air downwardly through the floor of the spray booth and through vertical passage means; and directing substantially all of the air leaving the lower end of said vertical passage means in one lateral direction toward one side of said booth, then upwardly, and then in the opposite lateral direction toward the other side of said booth and thereby directing a substantial portion of the air passed an intermediate portion of said vertical passage means for discharge through an exhaust structure positioned at said other side of said booth.

14. A paint spray booth for applying paint in a spraying operation to an article, said booth comprising:

an elongate housing defining a working area suitable for containing an article;

a longitudinally extending partition extending across the full width of said housing beneath said working area;

a plurality of hollow, vertically extending, longitudinally spaced members positioned beneath said full width partition and defining a plurality of vertical passages opening at their upper ends in said full width partition;

means for supplying air to the working area from overhead and for causing the air flow downwardly around the article and thence downwardly through said vertical passages so as to entrain overspray from the spraying operation and carry it downwardly through said vertical passages; and means for directing substantially all of the air leaving the lower ends of said vertical passages in one lateral direction to one side of said booth, then upwardly toward said full width partition, and then in the opposite lateral direction toward the other side of said booth and through the spaces between said hollow members for discharge through an exhaust structure positioned at said other side of said booth.

15. A paint spray booth according to claim 14 wherein said directing means comprises:

a partial width longitudinally extending partition surrounding the lower end portions of said hollow members in spaced relation to said full width partition;

a longitudinally extending base floor disposed beneath the lower ends of said hollow members; and a longitudinally extending vertical partition extending downwardly from said partial width partition to said base floor at the side of said hollow members facing said other side of said booth.

16. A spray booth according to claim 15 wherein:

said full width partition constitutes a pan for receiving water for cascading discharge downwardly through said hollow members to transfer the overspray from the air to the water; and said directing means is further defined by the undersurface of said pan.

17. A paint spray booth according to claim 16 wherein:

said booth further includes a longitudinally extending water trough positioned beneath the lower ends of said hollow members and defined by said base floor and said vertical partition.

* * * * *